United States Patent [19]

Yasuhara

[11] Patent Number: 4,594,979

[45] Date of Patent: Jun. 17, 1986

[54] FUEL INJECTION RATE CONTROL SYSTEM FOR AN ENGINE

[75] Inventor: Seishi Yasuhara, Yokosuka, Japan

[73] Assignee: Nissan Motor Company, Limited, Japan

[21] Appl. No.: 668,807

[22] Filed: Nov. 6, 1984

[30] Foreign Application Priority Data

Jan. 6, 1984 [JP] Japan ..... 59-646

[51] Int. Cl.[4] ..... F02D 31/00

[52] U.S. Cl. ..... 123/357

[58] Field of Search ..... 123/357, 358, 359, 478

[56] References Cited

U.S. PATENT DOCUMENTS

| | | | |
|---|---|---|---|
| 4,359,032 | 11/1982 | Ohie | 123/478 |
| 4,403,582 | 9/1983 | Yasuhara | 123/357 |
| 4,470,763 | 9/1984 | Yasuhara | 123/357 |
| 4,491,112 | 1/1985 | Kanegae et al. | 123/357 |
| 4,492,196 | 1/1985 | Oshizawa | 123/357 |
| 4,493,302 | 1/1985 | Kawamura | 123/357 |
| 4,494,507 | 1/1985 | Yasuhara | 123/478 |

FOREIGN PATENT DOCUMENTS

| | | | |
|---|---|---|---|
| 88431 | 5/1983 | Japan | 123/357 |

*Primary Examiner*—Magdalen Y. C. Moy

*Attorney, Agent, or Firm*—Lowe, King, Price & Becker

[57] ABSTRACT

A fuel injection pump serves to inject fuel into an engine. A movable member adjustably determines the rate of fuel injection into the engine. The fuel injection rate depends on the position of the movable member. A critical position of the movable member defines the boundary between a fuel injection enabling range and a fuel injection disabling range. This critical position is measured. An operating condition of the engine is sensed. The movable member is then controlled on the basis of the measured engine operating condition and the measured critical position.

5 Claims, 11 Drawing Figures

FUEL INJECTION RATE CONTROL SYSTEM FOR AN ENGINE

BACKGROUND OF THE INVENTION

1. Field of the Invention

This invention relates to a system for controlling the rate of fuel injection into an engine, such as a diesel engine.

2. Description of the Prior Art

In diesel engines, fuel is periodically injected into engine combustion chambers by means of fuel injection pumps. The quantity of fuel injected during each injection stroke is adjusted in accordance with operating conditions of the engines. Specifically, a movable control member or sleeve in the injection pump determining the fuel injection quantity is driven in response to the operating conditions of the engine.

It is known to adjust the position of the control member to a desired position dependent on the engine operating conditions by means of a feed-back control system. In this system, a position sensor monitors the actual position of the control member and generates a signal indicative thereof. On the basis of the difference between the actual position signal and a signal representing a desired position of the control member, an electrically-powered actuator drives the control member to adjust its actual position toward its desired position.

Even in this feed-back control system, at a fixed position of the control member, the fuel injection quantity in terms of mass varies as the fuel density changes. It should be noted that commercially available fuels for diesel engines have various densities. Also, the density of the fuel varies with its temperature. What is worse, in this system, the fuel injection quantity determined by the position of the control member varies as the sliding parts of the fuel injection pump wear away. Accordingly, the fuel injection quantity or rate in terms of mass does not have a constantly fixed relationship with the engine operating conditions. The relationship between the fuel injection quantity or rate in terms of mass and the engine operating conditions should be constantly fixed for reliable control of the engine.

SUMMARY OF THE INVENTION

It is an object of this invention to provide a fuel injection rate control system for an engine, such as a diesel engine, which exhibits a constantly fixed relationship between the fuel injection rate in terms of mass and at least one engine operating condition.

In accordance with this invention, a fuel injection pump serves to inject fuel into an engine. A movable member adjustably determines the rate of fuel injection into the engine. The fuel injection rate depends on the position of the movable member. A critical position of the movable member defines the boundary between a fuel injection enabling range and a fuel injection disabling range. This critical position is measured. An operating condition of the engine is sensed. The movable member is then controlled on the basis of the measured engine operating condition and the measured critical position.

DESCRIPTION OF THE PREFERRED EMBODIMENT

Figure 1:
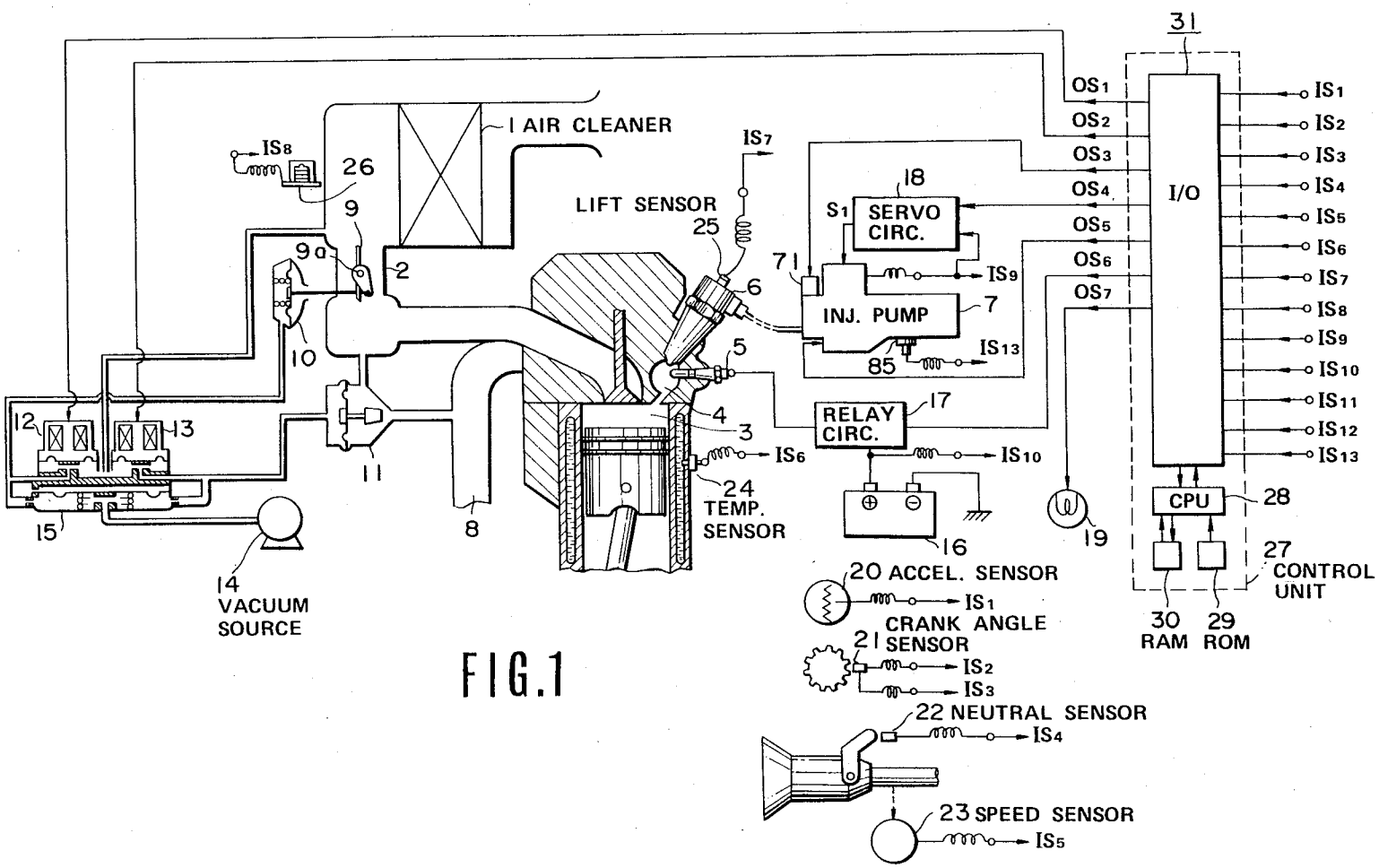
FIG. 1 is a diagram of a fuel injection rate control system according to this invention.

An engine, such as a diesel engine, has an air cleaner 1 installed in an air intake passage 2 leading to main combustion chambers 3, one of which is shown. The main chambers 3 each communicate with an auxiliary or swirl combustion chamber 4, into which a glow plug 5 projects. The outlets of fuel injection nozzles or valves 6, only one of which is shown, open into corresponding swirl chambers 4. A fuel injection pump 7 supplies fuel to the swirl chambers 4 and thus main chambers 3 via the fuel injection nozzles 6.

An exhaust passage 8 extends from the main combustion chambers 3. A throttle valve 9 is located in the intake passage 2 downstream of the air cleaner 1. A pressure-responsive vacuum actuator 10 drives the throttle valve 9. An exhaust gas recirculation control valve 11 is located in a passage connecting the exhaust passage 8 and the intake passage 2 downstream of the throttle valve 9. The control valve 11 has a pressure-responsive vacuum actuator which drives the valve member. An electrically-driven or electromagnetic valve 12 disposed in a passage connecting the actuator 10 to a point in the intake passage 2 upstream of the throttle valve 9 but downstream of the air cleaner 1 selectively allows and interrupts supply of atmospheric pressure to the actuator 10. Another electrically-driven or electromagnetic valve 13 disposed in a passage connecting the actuator of the control valve 11 to a point in the intake passage 2 upstream of the throttle valve 9 but downstream of the air cleaner 1 selectively allows and interrupts supply of atmospheric pressure to the actuator of the control valve 11. A vacuum source 14, such as a vacuum pump, communicates with the passage between the actuator 10 and the electromagnetic valve 12, and with the passage between the actuator of the control valve 11 and the electromagnetic valve 13 via a pressure-regulating valve 15 to supply regulated vacuum pressure to the actuator 10 and the actuator of the control valve 11.

A battery 16 is connected to the glow plug 5 to energize the latter. A relay circuit 17 disposed along the connection of the battery 16 to the glow plug 5 controls energization of the glow plug 5. A light bulb 19 indicates energization of the glow plug 5.

A servo circuit 18 is associated with the fuel injection pump 7 to drive an electrically-powered servo actuator (described hereinafter), such as an electric servomotor, which adjusts the rate of fuel injection into the combustion chambers 3 and 4 via the fuel injection pump 7 and the fuel injection nozzles 6.

An accelerator pedal position sensor 20 is associated with an accelerator pedal to generate a signal IS1 indicative of the position of the accelerator pedal, that is, the degree of depression of the accelerator pedal or the depression angle thereof. The sensor 20 includes a potentiometer mechanically linked to the accelerator pedal to output the voltage signal IS1 related to the position of the accelerator pedal. Generally, the signal IS1 represents the power required of the engine, that is, the load on the engine.

A crank angle sensor 21 is associated with the crankshaft or the camshaft of the engine to generate pulse signals IS2 and IS3 indicative of predetermined angles of engine revolution. For example, the pulses of the signal IS2 are outputted at predetermined crankshaft angular positions spaced at regular intervals of 120° in the case of a six-cylinder engine. In contrast, the pulses of the signal IS3 are outputted at regular intervals of 1° of engine revolution. In more detail, the sensor 21 includes the combination of a toothed disc and two magnetic pickups. In this case, the disc is mounted on the crankshaft or the camshaft of the engine, and the pickups are fixedly mounted near the disc. The teeth of the disc belong to two groups, one for the 1° pulses and the other for the 120° pulses. The first pickup is designed to generate an alternating voltage corresponding to the 1° pulse signal IS3. The second pickup is designed to generate an alternating voltage corresponding to the 120° pulse signal IS2. The sensor 21 also includes two waveform-shaping circuits which convert the alternating voltages into the corresponding pulse signals IS2 and IS3.

A neutral-position sensor 22 is associated with an engine power transmission to generate a signal IS4 indicative of whether or not the transmission is in the neutral position. The sensor 22 includes a switch actuated by the gear shift lever of the transmission. A rotational speed sensor 23 is associated with the output shaft of the transmission to generate a signal IS5 indicative of the rotational speed of the output shaft, that is, the vehicle speed in the case of a vehicular engine.

A coolant-temperature sensor 24 is attached to the engine in such a way that the sensing element of the sensor 24 is exposed to engine coolant. The sensor 24 generates a signal IS6 indicative of the temperature of the engine coolant.

A lift of displacement sensor 25 is associated with each of the fuel injection nozzles 6 to detect lift or displacement of the valve member of the associated fuel injection nozzle representing the actual timing of fuel injection as well as the occurrence of fuel injection. The lift sensor 25 generates a signal IS7 indicative of the timing and occurrence of fuel injection. The lift sensor 25 will be described in detail hereinafter.

A density sensor 26 exposed to the atmosphere generates a signal IS8 indicative of the density of atmosphere, which depends on the temperature and the pressure thereof.

The fuel injection pump 7 has a position sensor, described hereinafter, which generates a signal IS9 indicative of the position of a control sleeve determining the fuel injection quantity during each fuel injection stroke. The control sleeve will also be described hereinafter.

A connection to the battery 16 provides a signal IS10 indicative of the voltage across the battery 16.

A starter switch (not shown) provides a starter signal IS11, which indicates when the starter switch is closed to activate a starting motor.

A glow plug switch (not shown) provides a glow plug signal IS12, which indicates when the glow plug switch is closed to activate the glow plugs 5.

A fuel temperature sensor 85 attached to the fuel injection pump 7 generates a signal IS13 representing the temperature of fuel in the fuel injection pump 7.

A control unit 27 includes a central processing unit (CPU) 28, a read-only memory (ROM) 29, a read/write or random-access memory (RAM) 30, and an input/output (I/O) interface circuit 31. The central processing unit 28 is connected to the memories 29 and 30, and the input/output circuit 31 to form a microprocessor system.

The I/O circuit 31 is connected to all of the above sensors and the battery connection to receive the signals IS1, IS2, IS3, IS4, IS5, IS6, IS7, IS8, IS9, IS10, IS11, IS12, and IS13. It should be noted that the connections between the I/O section 31 and the sensors and the battery connection are omitted from the drawing for clarity. The control unit 27 generates control signals OS1, OS2, OS3, OS4, OS5, OS6, and OS7 IN accordance with the signals IS1, IS2, IS3, IS4, IS5, IS6, IS7, IS8, IS9, IS10, IS11, IS12, and IS13. The control signals OS1, OS2, OS3, OS4, OS5, OS6, and OS7 are outputted via the I/O circuit 31 and are generally intended to control the engine optimally.

The frequency of the pulses of the signal IS3 from the crank angle sensor 21 represents the rotational speed of the engine crankshaft. The I/O circuit 31 includes a frequency detector for determining the frequency of the pulses of the signal IS3 to monitor the engine rotational speed.

The I/O circuit 31 is connected to the electromagnetic valve 12 and 13 to supply the control signals OS1 and OS2 thereto, respectively. The control signals OS1 and OS2 are in the form of pulse trains. The higher levels of the control signals OS1 and OS2 energize the electromagnetic valves 12 and 13 to open. The lower levels of the control signals OS1 and OS2 de-energize the electromagnetic valves 12 and 13 and thus close them. When the electromagnetic valves 12 and 13 are opened, atmospheric air is permitted to enter the actuator 10 and the actuator of the control valve 11 via the valves 12 and 13, thus raising the pressures applied to the actuators. When the electromagnetic valves 12 and 13 are closed, air supply to the actuators is interrupted, thus lowering the pressures applied thereto toward the vacuum pressure defined by the regulating valve 15. As a result, the resultant pressure applied to the actuator 10 depends on the duty cycle of the control signal OS1, so that the position of the throttle valve 9 also depends on the duty cycle of the control signal OS1. Similarly, the resultant pressure applied to the actuator of the control valve 11 depends on the duty cycle of the control signal OS2, so that the position of the control valve 11 also depends on the duty cycle of the control signal OS2. The rate of exhaust gas recirculation depends on the positions of the valves 9 and 11. When the rate of exhaust gas recirculation needs to be changed, the control unit 27 adjusts the duty cycles of the control signals OS1 and OS2 in a suitable manner.

The I/O circuit 31 is connected to an electrically-driven or electromagnetic fuel supply cut-off valve 71 to output the control signal OS3 thereto. The cut-off valve 71 is attached to the fuel injection pump 7 to selectively block and open a fuel feed line in the pump 7. The control signal OS3 is a binary signal with higher and lower levels representing energization and de-energization of the cut-off valve 71 respectively. Energizing the cut-off valve 71 causes it to open, thereby allowing fuel supply to the combustion chambers 3 and 4. De-energizing the cut-off valve 71 causes it to close, thereby interrupting the fuel supply to the combustion chambers 3 and 4. When the engine needs to be stopped, the control unit 27 changes the control signal OS3 to the lower level to interrupt the fuel supply to the engine.

The I/O circuit 31 is connected to the servo circuit 18 to output the control signal OS4 thereto. This control signal OS4 represents a desired position of a control sleeve determining the fuel injection quantity during each fuel injection stroke. The control sleeve will be described in detail hereinafter. The servo circuit 18 is connected to a position sensor, described hereinafter, to receive a signal IS9 representing the actual position of the control sleeve. On the basis of the comparison or difference between the desired and actual positions of the control sleeve represented by the signals OS4 and IS9 respectively, the servo circuit 18 generates a control signal S1 applied to an electrically-powered servo actuator, such as an electric servomotor, for driving the control sleeve. The control signal S1 is designed to adjust and hold the actual position of the control sleeve to its desired position.

The control signal OS4 is in the form of a pulse train having an adjustable duty cycle. The desired position of the control sleeve is represented by the duty cycle of the control signal OS4. Accordingly, the duty cycle of the control signal OS4 varies with the desired position of the control sleeve. The servo circuit 18 includes a duty-cycle-to-voltage convertor. This convertor receives the control signal OS4 and converts it into a voltage signal having an amplitude which varies with the duty cycle of the control signal OS4, that is, the desired position of the control sleeve. The amplitude of the signal IS9 varies with the actual position of the control sleeve. The servo circuit 18 includes a different circuit receiving the voltage signal from the convertor and the signal IS9. This difference circuit generates the control signal S1 having a current or voltage which varies as a function of the difference in voltage between the voltage signal from the convertor and the signal IS9, that is, the difference between the desired and actual positions of the control sleeve.

The I/O circuit 31 is connected to a fuel injection timing adjustment mechanism (described hereinafter) in the fuel injection pump 7 to output the control signal OS5 thereto. The control unit 27 controls the timing adjustment mechanism via the control signal OS5. In more detail, the control unit 27 determines a desired timing of fuel injection on the basis of the engine speed and load derived from the signals IS1 and IS3. Then, the control unit 27 determines the difference between the desired fuel injection timing and the actual fuel injection timing derived from the signal IS7 and finally outputs the signal OS5 designed to adjust the actual timing toward the desired timing.

The I/O circuit 31 is connected to the glow relay 17 to output the control signal OS6 thereto. The control unit 27 controls the glow relay 17 via the control signal OS6 so as to control energization and de-energization of the glow plugs 5.

The I/O circuit 31 is connected to the glow light 19 to output the control signal OS7 thereto. The control unit 27 controls the energization and de-energization of the glow light 19 via the control signal OS7 so that the glow light 19 indicates whether the glow plugs 5 are energized or de-energized.

Figure 2:
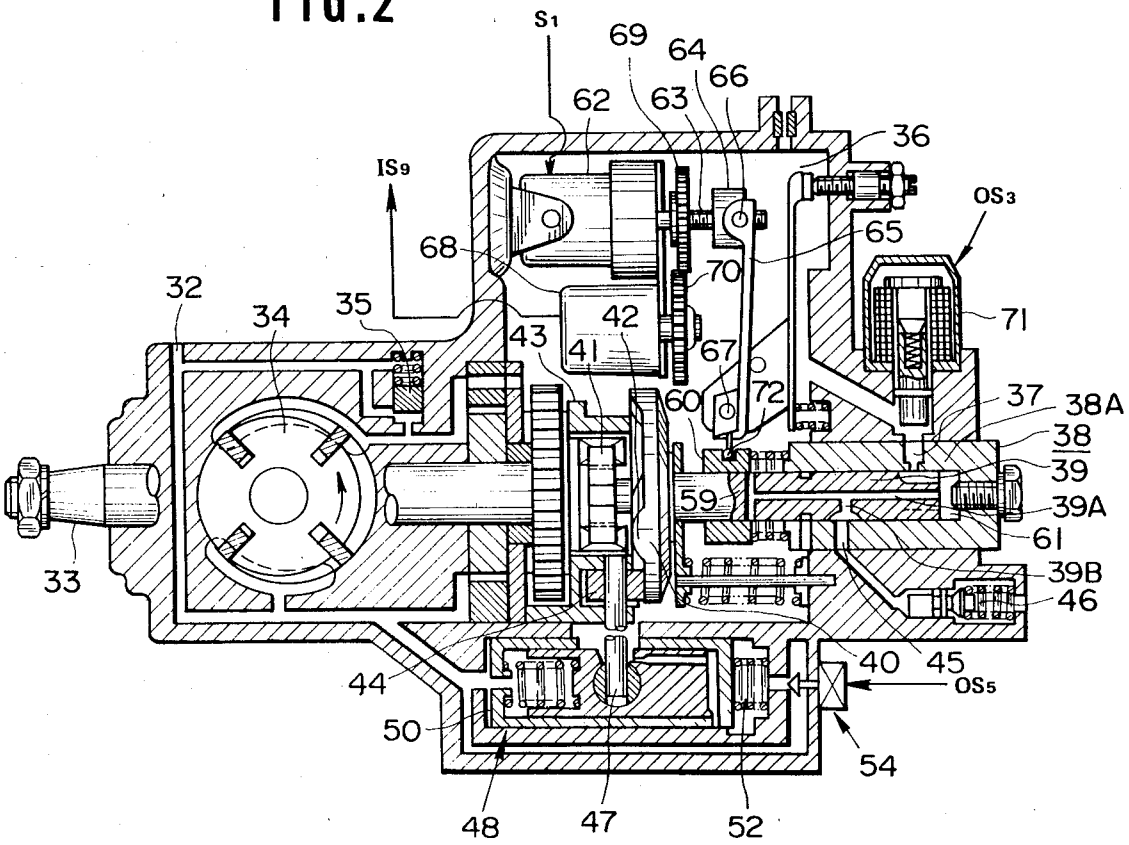
FIG. 2 is a longitudinal section view of the fuel injection pump of FIG. 1.

FIG. 2 shows the fuel injection pump 7 in detail, which includes a fuel inlet 32, a drive shaft 33, and a rotary or vane feed pump 34. It should be noted that the feed pump 34 is illustrated in two ways, one being normal and the other being rotated through 90° about the vertical. The fuel inlet 32 is provided in the housing of the pump 7 and leads to the inlet of the feed pump 34. Fuel can be conducted from a fuel tank (not shown) to the fuel inlet 32 by means of a suitable fuel line (not shown). The feed pump 34 draws fuel from the tank via the fuel inlet 32. The feed pump 34 is mounted on the drive shaft 33 connected to the crankshaft of the engine by a gear-down coupling (not shown). Accordingly, the engine drives the feed pump 34. The coupling between the crankshaft and the drive shaft 33 is so designed that the drive shaft 33 rotates at half the speed of rotation of the crankshaft.

A pressure control valve 35 is connected across the feed pump 34 to control the fuel pressure across the feed pump 34 and more particularly to cause it to increase linearly with the engine rotational speed. The outlet of the feed pump 34 communicates with a pump chamber 36 in the housing of the fuel injection pump 7 to supply pressurized fuel to the pump chamber 36. The fuel injection pump 7 includes a high-pressure plunger pump 38, which communicates with the pump chamber 36 via an intake port 37 formed in the housing of the fuel injection pump 7. The plunger pump 38 draws fuel from the pump chamber 36 via the intake port 37. In this case, fuel flows through the pump chamber 36 while lubricating and cooling moving parts (described hereinafter) in the pump chamber 36.

The high-pressure pump 38 includes a plunger 39 secured coaxially to a cam disc 40. The cam disc 40 engages the drive shaft 33 via a key coupling 41 so as to rotate along with the drive shaft 33 but be permitted to move axially relative to the drive shaft 33. The cam disc 40 has identical cam faces 42 spaced around one surface at regular angular intervals. The number of the cam faces 42 is equal to the number of the combustion chambers 3 (see FIG. 1). The cam disc 40 is urged by a spring (not labelled) into engagement with a set of identical rollers 44 supported by a roller ring 43 which is stationary in the axial direction with respect to the cam disc 40. The rollers 44 are spaced circumferentially in a manner corresponding to that of the cam faces 42. As the cam faces 42 pass over the rollers 44, the cam disc 40 and the plunger 39 reciprocate axially within a predetermined range defined by the profiles of the cam faces 42. In this way, as the drive shaft 33 rotates, the plunger 39 rotates while reciprocating axially.

The high-pressure pump 38 includes a sleeve or barrel 38A fixed to the housing of the fuel injection pump 7. This barrel 38A has a blind bore into which the plunger 39 slidably extends. The barrel 38A and the plunger 39 define a pumping or working chamber 61 at the blind end of the barrel bore. As the plunger 39 reciprocates axially, the working chamber 61 contracts and expands.

The peripheral surface of the end of the plunger 39 has angularly spaced fuel intake grooves (not labelled) opening into the working chamber 61. The number of these fuel intake grooves is equal to the number of the engine combustion chambers 3. The fuel intake port 37 extends through the cylindrical walls of the barrel 38A and opens into the bore of the barrel 38A. As the plunger 39 rotates, the end of the fuel intake port 37 comes into register or communication with each of the fuel intake grooves in turn. While the plunger 39 moves axially through its working chamber expansion stroke, the communication between the fuel intake port 37 and one of the fuel intake grooves is maintained so that fuel is drawn from the pump chamber 39 into the working chamber 61 via the fuel intake passages. In this way, fuel intake stroke is performed.

The plunger 39 has an axial passage 39A extending from the working chamber 61. A radial fueldistribution passage 39B formed in the plunger 39 extends from the axial passage 39A and opens onto the peripheral surface of the plunger 39 within the barrel 38A. Fuel delivery ports 45 formed in the walls of the housing of the fuel injection pump 7 extend between the interior of the barrel 38A and the outer surfaces of the injection pump housing. The number of these fuel delivery ports 45 is equal to the number of the engine combustion chambers 3. The fuel delivery ports 45 have angularly spaced inner ends. As the plunger 39 rotates, the outer end of the fuel-distribution passage 39B comes into register or communication with each of the fuel delivery ports 45 in turn. While the plunger 39 moves axially through its working chamber contraction stroke, the communication between the fuel-distribution passage 39B and one of the fuel delivery ports 45 is maintained so that fuel can be driven out of the working chamber 61 toward the fuel delivery port via the passages 39A and 39B. It should be noted that the fuel intake port 37 remains disconnected from the fuel intake grooves during the working chamber contraction stroke. As shown in FIG. 1, the fuel delivery ports 45 are connected to the corresponding fuel injection nozzles 6. After being discharged from the high-pressure pump 38, fuel travels along the fuel delivery port 45 and is then injected via the fuel injection valve 6 into the corresponding combustion chamber 4. In this way, fuel injection stroke is performed. A check valve 46 disposed in each of the fuel delivery ports 45 allows fuel flow only in the direction toward the corresponding fuel injection nozzle 6.

The plunger 39 has a diametrical spill port 59 extending therethrough. The axial passage 39A opens into this spill port 59 so that the working chamber 61 is in communication with the port 59. A control sleeve 60 (mentioned previously) for adjustably determining the fuel injection quantity is coaxially, slidably mounted on a segment of the plunger 39 exposed to the pump chamber 36. The location of the ends of the spill port 59 relative to the control sleeve 60 is chosen so that the ends of the spill port 59 can usually be blocked at first and then be opened by the control sleeve 60 as the plunger 39 moves axially through its working chamber contraction stroke. The blockage of the spill port 59 allows fuel injection into the engine combustion chambers. The opening or unblockage of the spill port 59 exposes the ends of the port 59 to the pump chamber 36, thereby returning fuel from the working chamber 61 to the pump chamber 36 via the ports 39A and 59 and thus disabling or interrupting fuel injection. The axial position of the control sleeve 60 determines the timing of interruption of the fuel injection in units of angle of the engine crankshaft. In other words, the part of the working chamber contraction stroke which actually effects fuel injection depends on the axial position of the control sleeve 60. Accordingly, the axial position of the control sleeve 60 determines the quantity of fuel injected during each fuel injection stroke.

An electric servomotor 62 (mentioned previously) which is located in the pump chamber 36 serves to move the control sleeve 60 axially. The motor 62 has a threaded shaft 63 on which an axially movable member 64 is mounted. The member 64 has a corresponding threaded hole extending therethrough. The shaft 63 passes through the hole of the member 64, so that the member 64 engages the shaft 63 via the threads. The member 64 is supported in such a manner as to be incapable of rotating along with the shaft 63, and therefore the member 64 moves axially with respect to the shaft 63 as the shaft 63 rotates. A link lever 65 is pivotally supported on the housing of the fuel injection pump 7 via a pin 67 located between the ends of the lever 65. One of the ends of the lever 65 is pivotally connected to the movable member 64 by a pin 66, and the other is pivotally connected to the control sleeve 60 by a ball-and-socket joint 72. The axis of the shaft 63 is parallel to the axis of the control sleeve 60. As the member 64 moves axially due to rotation of the shaft 63, the lever 65 pivots about the pin 67 and forces the control sleeve 60 to move in the opposite direction along the axis of the plunger 39.

The motor 62 is electrically connected to the control circuit 18 (see FIG. 1) to receive the control signal S1 therefrom. Specifically, the angular position or rotation of the shaft 63 is determined by the control signal S1, which responds to the control signal OS4 and the position signal IS9 as described previously.

A previously described sensor for monitoring the axial position of the control sleeve 60 includes a potentiometer 68 having a rotatable adjustment arm. A gear 69 mounted on the motor shaft 63 meshes with a gear 70 mounted on the adjustment arm, so that the adjustment arm rotates as the motor shaft 63 rotates. Since the control sleeve 60 moves axially as the motor shaft 63 rotates, the angular position of the adjustment arm depends on the axial position of the control sleeve 60. A constant voltage is applied across the resistor of the potentiometer so that the voltage between one end of the resistor and a sliding point of the resistor depending on the angular position of the adjustment arm varies as the adjustment arm rotates. Accordingly, this variable voltage represents the axial position of the control sleeve 60. The variable voltage is used as the position signal IS9.

The temperature sensor 85 (see FIG. 1, not shown in FIG. 2) has a sensing section exposed to the fuel in the pump chamber 36. Accordingly, the signal IS13 from this sensor 85 represents the temperature of fuel in the pump chamber 36.

As described above, the electromagnetic fuel supply cut-off valve 71 is provided to interrupt fuel injection upon need. The valve 71 is so positioned within the housing of the fuel injection pump 7 as to be able to selectively block and open the fuel intake port 37. Blocking the fuel intake port 37 with the valve 71 interrupts the fuel supply from the pump chamber 36 to the working chamber 61, thereby disabling fuel injection.

Opening the fuel intake port 37 enables fuel injection. The valve 71 is connected to the control unit 27 (see FIG. 1) to receive the control signal OS3 therefrom, through which the control unit 27 controls the valve 71.

The roller ring 43 can be pivoted slightly about the axis of rotation of the cam disc 40. The angular position of the roller ring 43 determines the timing in units of angles of engine crankshaft rotation at which the cam faces 42 encounter the rollers 44, and therefore determines the timing of the start of each fuel injection stroke in units of crank angle. In other words, the fuel injection timing depends on the angular position of the roller ring 43.

A driving pin 47 connects the roller ring 43 to a spring-loaded slidable piston unit 48. The piston unit 48 so aligned that its axial movement causes pivotal displacement of the roller ring 43. It should be noted that the illustration of the piston unit 48 and associated parts is rotated through 90° about the vertical in order to show the details thereof. Thus, the fuel injection timing depends on the position of the piston unit 48. A reference pressure chamber 50 at one end of the piston unit 48 communicates with the inlet of the feed pump 34 so that it is exposed to the pressure at the inlet of the pump 34. An adjustable pressure chamber 52 at the other end of the piston unit 48 usually communicates with the pump chamber 36 via an orifice or a restriction. Since the pressure in the pump chamber 36 is equal to the pressure in the outlet of the feed pump 34, the adjustable pressure chamber 52 can be exposed to the pressure in the outlet of the pump 34. In this way, the piston unit 48 is subjected to the pressure differential between the chambers 50 and 52 which results from operation of the feed pump 34. The position of the piston unit 48 generally depends on this pressure differential. The chamber 50 and 52 communicate with each other via a passage (not labelled). An electrically-driven ON-OFF valve 54 serves to selectively block and open this communication passage. As the valve 54 opens the communication passage, the pressure in the adjustable pressure chamber 52 drops toward a level equal to the pressure in the reference pressure chamber 50 so that the pressure differential across the piston unit 48 also decreases. As the valve 54 blocks the communication passage, the pressure in the adjustable pressure chamber 52 rises toward a level equal to the pressure at the outlet of the feed pump 34 so that the pressure differential across the piston unit 48 also increases. When electrically energized and de-energized, the valve 54 is closed and opened respectively. The control signal OS5 driving the valve 54 is in the form of a pulse train having a high frequency and an adjustable duty cycle. Since the frequency of the control signal OS5 is high, the pressure in the adjustable pressure chamber 52 is held at a level specified by the duty cycle of the control signal OS5. Accordingly, the pressure differential across the piston unit 48 depends on the duty cycle of the control signal OS5 so that the position of the piston unit 48 varies with the duty cycle of the control signal OS5. The control unit 27 controls the fuel injection timing via adjustment of the duty cycle of the control signal OS5.

Figure 3:
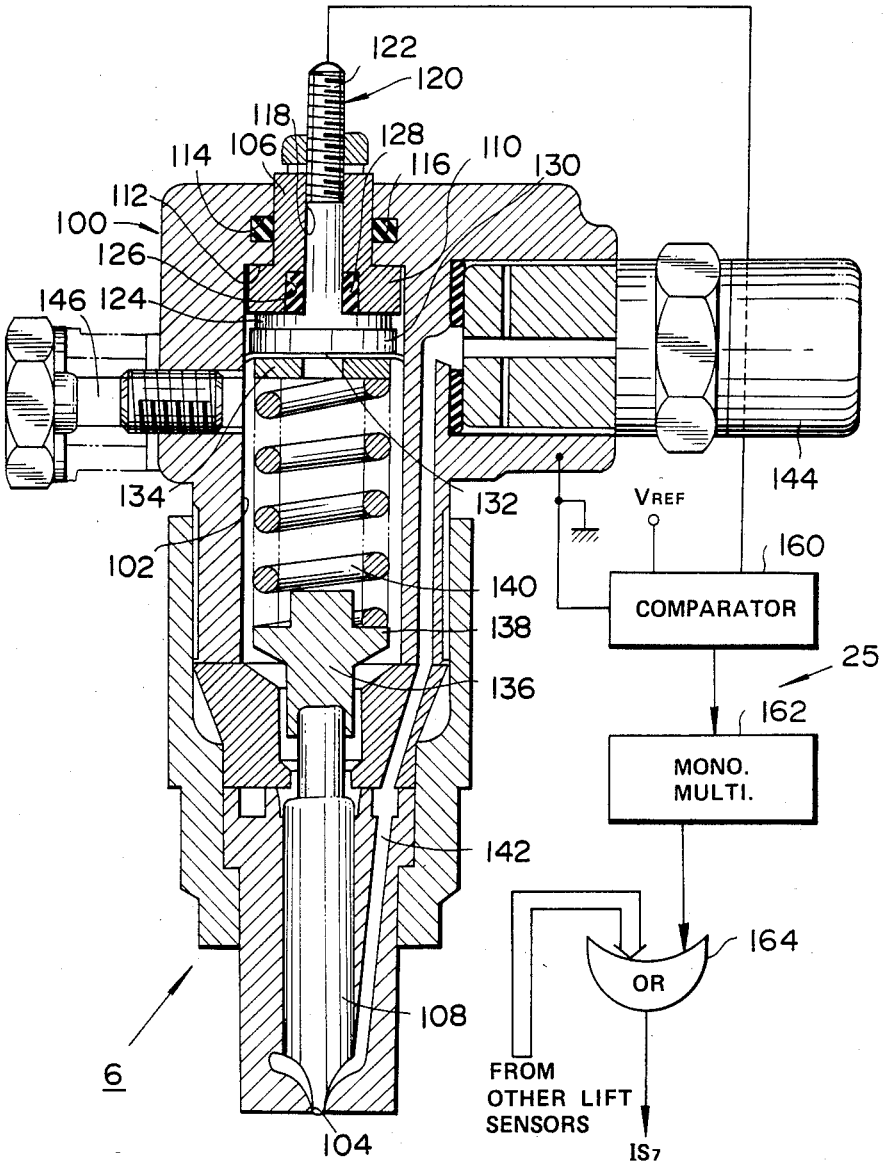
FIG. 3 is a longitudinal section view of the fuel injection nozzle and the lift sensor of FIG. 1.

FIG. 3 shows one of the fuel injection nozzles 6 in detail, each of which includes a lift sensor 25. The injection nozzle 6 has a body 100 approximately in the form of a vertically aligned cylinder. The nozzle body 100 is provided with a coaxial hole 102 extending therethrough. The walls of the nozzle body 100 defining the lower end of the hole 102 taper radially into the hole 102 in such a manner as to form an injection orifice 104 at the lower end of the hole 102. The upper end of the hole 102 is closed by a cylindrical insulating member 106 coaxially fitting into the upper end of the hole 102.

A solid cylindrical valve needle 108 is coaxially, slideably disposed in the lower part of the hole 102. The outside diameter of the valve needle 108 is essentially equal to the diameter of the lower part of the hole 102 so that the valve needle 108 is effectively in sealing contact with the nozzle body 100. The lower end of the valve needle 108 tapers and normally fits into the orifice 104, abutting the inner surfaces of the nozzle body 100 defining the orifice 104 in order to block the latter. Axial movement of the valve needle 108 away from the orifice 104, that is, lift of the valve needle 108, opens the orifice 104.

The lower end of the insulating member 106 has a radial flange 110 within the hole 102. The wall of the nozzle body 100 defining the upper end of the hole 102 is provided with a radial shoulder 112 and a circumferential groove 114 above the shoulder 112. The flange 110 abuts the shoulder 112 to limit axially upward movement of the insulating member 106. A sealing ring 116 is located in the groove 114 and abuts both the nozzle body 100 and the insulating member 106 in order to prevent fuel leakage through the upper end of the hole 102.

The insulating member 106 also has a coaxial hole 118 extending therethrough. An electrode 120 has a shaft 122 and a disc flange 124 extending radially from one end of the shaft 122. The electrode 120 is arranged in such a manner that the flange 124 is positioned coaxially within the hole 102 immediately below the insulating member 106 and that the shaft 122 snugly passes through the hole 118. The flange 124 abuts the lower end surface of the insulating member 106 to limit axially upward movement of the electrode 120. The flange 124 is not in contact with the nozzle body 100. The insulating member 106 electrically insulates the electrode 120 from the nozzle body 100. The wall of the insulating member 106 defining the lower end of the hole 118 is provided with a circumferential groove 126 extending axially from the lower face of the insulating member 106. A sealing ring 128 is located in the groove 126 and abuts both the insulating member 106 and the electrode 120 in order to prevent fuel leakage through the hole 118.

A piezoelectric disc 130 is coaxially disposed in the hole 102 immediately below the flange 124 of the electrode 120. The diameter of the piezoelectric element 130 is chosen so that the element 130 does not come into contact with the nozzle body 100 in order to be electrically and mechanically insulated from the latter. The piezoelectric element 130 is sandwiched between the flange 124 and a grounding plate electrode 132 disposed in the hole 102. The upper surface of the piezoelectric element 130 contacts the electrode 120, and the lower surface thereof contacts the other electrode 132. The periphery of the electrode 132 contacts the walls of the nozzle body 100 defining the hole 102 so that the electrode 132 is electrically connected to the nozzle body 100.

A ring 134 is coaxially disposed in the hole 102 immediately below the electrode 132. A solid cylindrical fitting 136 is coaxially secured to the upper end of the valve needle 108 within the hole 102. The fitting 136 has a radially extending annular flange 138. A compression helical spring 140 is disposed in the hole 102, and is seated between the flange 138 and the ring 134. The spring 140 urges the fitting 136 and the valve needle 108 downwards to normally hold the lower end of the valve needle 108 in contact with the inner surfaces of the nozzle body 100 defining the orifice 104 and thus block the orifice 104. The spring 140 urges the ring 134, the electrode 132, the piezoelectric element 130, the flange 124 of the electrode 120, and the flange 110 of the insulating member 106 upwards against the shoulder 112 of the nozzle body 100. The electrode 132 is designed so as to transmit mechanical force between the ring 134 and the piezoelectric element 130 while maintaining electrical contact with the nozzle body 100.

A fuel passage 142 is provided within the walls of the nozzle body 100. One end of the fuel passage 142 communicates with the delivery port 45 in the fuel injection pump 7 (see FIG. 2) via a suitable fuel line and a fuel inlet 144 secured to the nozzle body 100. The fuel injection pump 7 supplies pulsatorily pressurized fuel to the fuel passage 142. The other end of the fuel passage 142 opens into the lower end of the hole 102 at such a position that the pressure of fuel introduced into the lower end of the hole 102 via the fuel passage 142 will be applied to the tapered surfaces of the lower end of the valve needle 108 to exert an upwardly directed force on the valve needle 108.

A vent or drain 146 is secured to the nozzle body 100. The drain 146 communicates with the hole 102 above the valve needle 108 to allow fuel leaking from the lower end of the hole 102 along the periphery of the valve needle 108 to exit the nozzle body 100.

When the pressure of fuel introduced into the lower end of the hole 102 exceeds a predetermined level, the valve needle 108 is moved up or lifted against the force of the spring 140, thereby opening the orifice 104 to allow fuel injection therethrough. When the pressure of fuel drops below the predetermined level, the valve needle 108 drops back or returns to its normal or closed position, blocking the orifice 104 and interrupting fuel injection. Lift of the valve needle 108 depends on the pressure of fuel introduced into the lower end of the hole 102 and thus on the fuel pressure applied to the tapered surfaces of the lower end of the valve needle 108.

The nozzle body 100 is mounted onto the cylinder head of the engine in a conventional manner in which the injection orifice 104 opens into the swirl combustion chamber 4 (see FIG. 1) to allow fuel to be injected into the swirl chamber 4.

As the valve needle 108 moves up and down to initiate and interrupt fuel injection, the force exerted on the piezoelectric element 130 varies because the force due to the pulsatile fuel pressure is transmitted to the piezoelectric element 130 via the valve needle 108, the fitting 136, the spring 140, the ring 134, and the electrode 132. Variations in the force exerted on the piezoelectric element 130 cause the piezoelectric element 130 to produce a varying electromotive force reflecting the mechanic force. The resulting voltage across the piezoelectric element 130 is outputted via the electrode 120, and via the electrode 132 and the nozzle body 100. To this end, the nozzle body 100 should be made of an electrically conductive material. The voltage across the piezoelectric element 130 rises and falls as the force transmitted thereto increases and decreases, that is, as the valve needle 108 moves up and down. In other words, the voltage across the piezoelectric element 130 varies in accordance with the variation of lift of the valve needle 108.

The first input terminal of a comparator 160 is electrically connected to the electrode 120 to receive the voltage across the piezoelectric element 130. In this case, the grounding terminal of the comparator 160 is electrically connected to the nozzle body 100 which is grounded. The second input terminal of the comparator 160 is supplied with a reference voltage $V_{REF}$. The comparator 160 outputs a binary signal which is high when the voltage across the piezoelectric element 130 is greater than the reference voltage $V_{REF}$ and is low otherwise. The reference voltage $V_{REF}$ is chosen so that the rising edge of each pulse output by the comparator 160 coincides with the start of lift or upward movement of the valve needle 108, and that each falling edge coincides with the end of lift or downward movement of the valve needle 108.

The input terminal of a monostable multivibrator 162 is connected to the output terminal of the comparator 160. Triggered by each rising edge in the output of the comparator 160, the multivibrator 162 outputs a short positive pulse. The rising edge of each pulse of the output of the multivibrator 162 occurs when lift or upward movement of the valve needle 108 starts, and thus indicates the start of each lift of the valve needle 108, that is, the start of each actual fuel injection cycle. In general, the pulses from the multivibrator 162 represent the occurrences of fuel injection.

Each of the fuel injection nozzles 6 includes a lift sensor 25 identical to that described above. The output terminals of all of the lift sensors 25, that is, of all of the multivibrators 162 are connected to input terminals of an OR gate 164. The output of the OR gate 164 constitutes the fuel injection start signal IS7, which indicates the actual timing of each fuel injection cycle in one of the fuel injection nozzles 6 and also the occurrence of each fuel injection. The output terminal of the OR gate 164 is connected to the I/O section 31 of the control unit 27 (see FIG. 1) to feed the fuel injection start signal IS7 thereto.

The lift sensor 25 may also be of a different type including a pressure responsive actuator, a switch operated by the actuator, and a d.c. power source electrically connected in series with the switch. In this case, the actuator is designed to respond to the pressure in the fuel passage 142 such that the switch is closed to transmit the voltage from the power source when the pressure in the fuel passage 142 rises to a predetermined level representing the beginning of a fuel injection stroke. Thus, a change in the voltage transmitted via the switch occurs as the fuel injection stroke starts. The voltage transmitted via the switch is used as the fuel injection start signal IS7.

Even at a fixed position of the control sleeve 60 in the fuel injection pump 7, the fuel injection quantity varies as the density of fuel changes. It should be noted that different fuels have different densities and that the density of fuel varies with its temperature as well. Furthermore, the fuel injection quantity varies as the sliding parts of the high-pressure pump 38 wear away.

Figure 4:
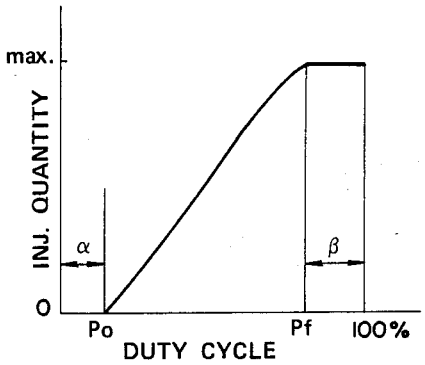
FIG. 4 is a graph of the relationship between the duty cycle of the control signal OS4 and the fuel injection quantity.

FIG. 4 illustrates a typical relationship between the fuel injection quantity Q and the duty cycle of the control signal OS4 which determines the axial position of the control sleeve 60. In a duty cycle range $\alpha$ between zero and a critical point Po, the fuel injection quantity remains zero. As the duty cycle increases from the critical point Po to another point Pf, the fuel injection quantity Q increases from zero to a maximum level at essentially a constant slope. In a duty cycle range $\beta$ between the point Pf and 100%, the fuel injection quantity Q remains at its maximum level. These dead zones $\alpha$ and $\beta$ are provided to compensate for changes in tolerances between moving parts of the high-pressure pump 38.

Figure 5:
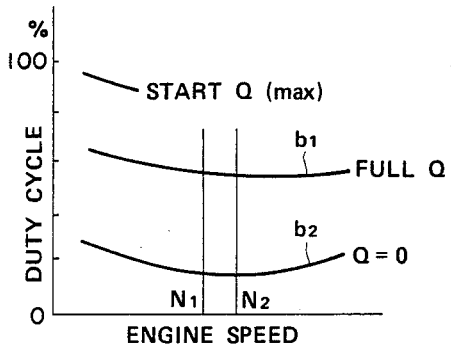
FIG. 5 is a graph of the relationship between the engine speed and the duty cycle of the control signal OS4 at different fixed fuel injection quantities.

As shown in FIG. 5, the duty cycles of the control signal OS4 determining fixed fuel injection quantities vary with engine speed. The characteristic curve b1 corresponds to the case of maximum fuel injection quantity (FULL Q). The characteristic curve b2 corresponds to the case of minimum fuel injection quantity, that is, no fuel injection (Q=0). It should be noted that in the intermediate engine speed range between values N1 and N2, the duty cycles determining the fixed fuel injection quantities remain essentially constant with respect to engine speed.

Figure 6:
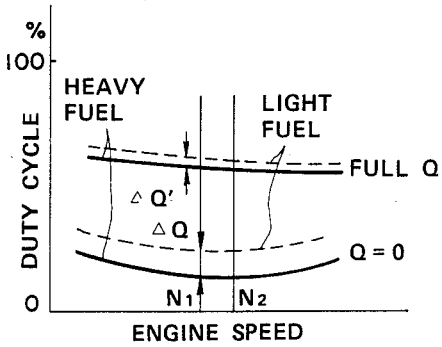
FIG. 6 is a graph similar to that of FIG. 5 showing curves for heavy fuel and light fuel.

FIG. 6 shows characteristic curves similar to those of FIG. 5 obtained in cases where light and heavy fuels of different densities are used. The dashed curves represent results for light fuel while the solid curves represent the case of heavy fuel. The duty cycle for light fuel must be greater than the corresponding duty cycle of heavy fuel. Accordingly, at a fixed duty cycle, the fuel injection quantity of heavy fuel will be greater then the fuel injection quantity of light fuel.

Figure 7:
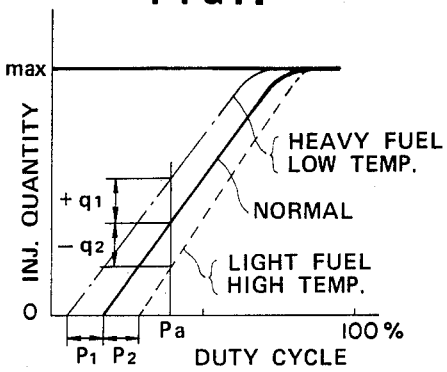
FIG. 7 is a graph similar to that of FIG. 4 showing curves for fuels at three different temperatures.

FIG. 7 illustrates relationships similar to that of FIG. 4 obtained in cases where the engine speed is constant and three kinds of fuel of different densities are used at three different temperatures. The solid curve in FIG. 7 corresponds to the case where a normal fuel having an intermediate density is used and the fuel temperature is intermediate or normal. The dashed curve in FIG. 7 corresponds to the case where a light fuel having a low density is used and the fuel temperature is high. The dot and dash curve in FIG. 7 corresponds to the case where a heavy fuel having a high density is used and the fuel temperature is low. In general, at a fixed duty cycle, the fuel injection quantity Q increases as the density of fuel increases or the fuel temperature drops.

At a certain duty cycle Pa, the fuel injection quantity in the case of heavy fuel and low temperature is greater than the fuel injection quantity in the case of normal fuel and normal temperature by an amount +q1. At the same duty cycle Pa, the fuel injection quantity in the case of light fuel and high temperature is smaller than the fuel injection quantity in the case of normal fuel and normal temperature by an amount −q2. The duty cycle at which the fuel injection quantity rises from zero, for heavy fuel and low temperature, is lower than a similar point for normal fuel and normal temperature by an interval P1. The duty cycle at which the fuel injection quantity rises from zero, for light fuel and high temperature, is greater than a similar point for normal fuel and normal temperature by an interval P2. The deviations +q1 and −q2 in the fuel injection quantity can be deduced or estimated on the basis of the deviations P1 and P2 in the duty cycle. Such deduction or estimation can be applied to cases of any kind of fuel and any temperature.

In this way, the critical duty cycle at which the fuel injection quantity rises from zero depends on the kind of fuel and the temperature of fuel. Since the position of the control sleeve 60 is determined by the duty cycle, the critical position of the control sleeve 60 at which the fuel injection quantity rises from zero depends on the kind and temperature of fuel. One major reason for this phenomenon is as follows: in cases where the control sleeve 60 blocks or essentially blocks the spill port 59, fuel leaks from the port 59 to the pump chamber 36 via a gap between the sleeve 60 and the plunger 39 as the working chamber 61 contracts. When the rate of fuel leakage exceeds a certain level, fuel injection is fully disabled. This rate of fuel leakage depends on the kinematic viscosity of the fuel which varies as a function of the kind and temperature of fuel. The rate of fuel leakage also depends on the flow resistance in the gap which varies as a function of the position of the control sleeve 60 relative to the position of the plunger 39.

It is difficult to directly measure the actual fuel injection quantity of different fuels at different densities and temperatures. It is easy to determine the duty cycle value at which the fuel injection quantity rises from or drops to zero by means of the lift sensors 25 for any fuel and at any temperature. Accordingly, in this invention, the duty cycle value at which the fuel injection quantity rises from or drops to zero is first determined. Then, the deviation of this point from a similar point of duty cycle in the case of a normal fuel at a normal temperature is calculated. Finally, the deviation of fuel injection quantity with respect to the case of a normal fuel at a normal temperature is deduced or estimated on the basis of the calculated duty cycle deviation.

This deduction or estimation also compensates for variations in the fuel injection quantity due to abrasive wear on the sliding parts of the high-pressure pump 38. In general, as the sliding parts wear away, an unwanted leakage of fuel increases and the actual fuel injection quantity decreases so that the critical duty cycle value at which the fuel injection quantity rises from or drops to zero increases.

Under engine operating conditions wherein fuel injection is performed, it is difficult to determine the duty cycle value at which the fuel injection quantity rises from or drops to zero without disturbing the engine operation. During coasting or engine braking, fuel supply to the engine is unnecessary so that it is possible then to determine the duty cycle value at which the fuel injection quantity rises from or drops to zero without disrupting engine operation.

Figure 8:
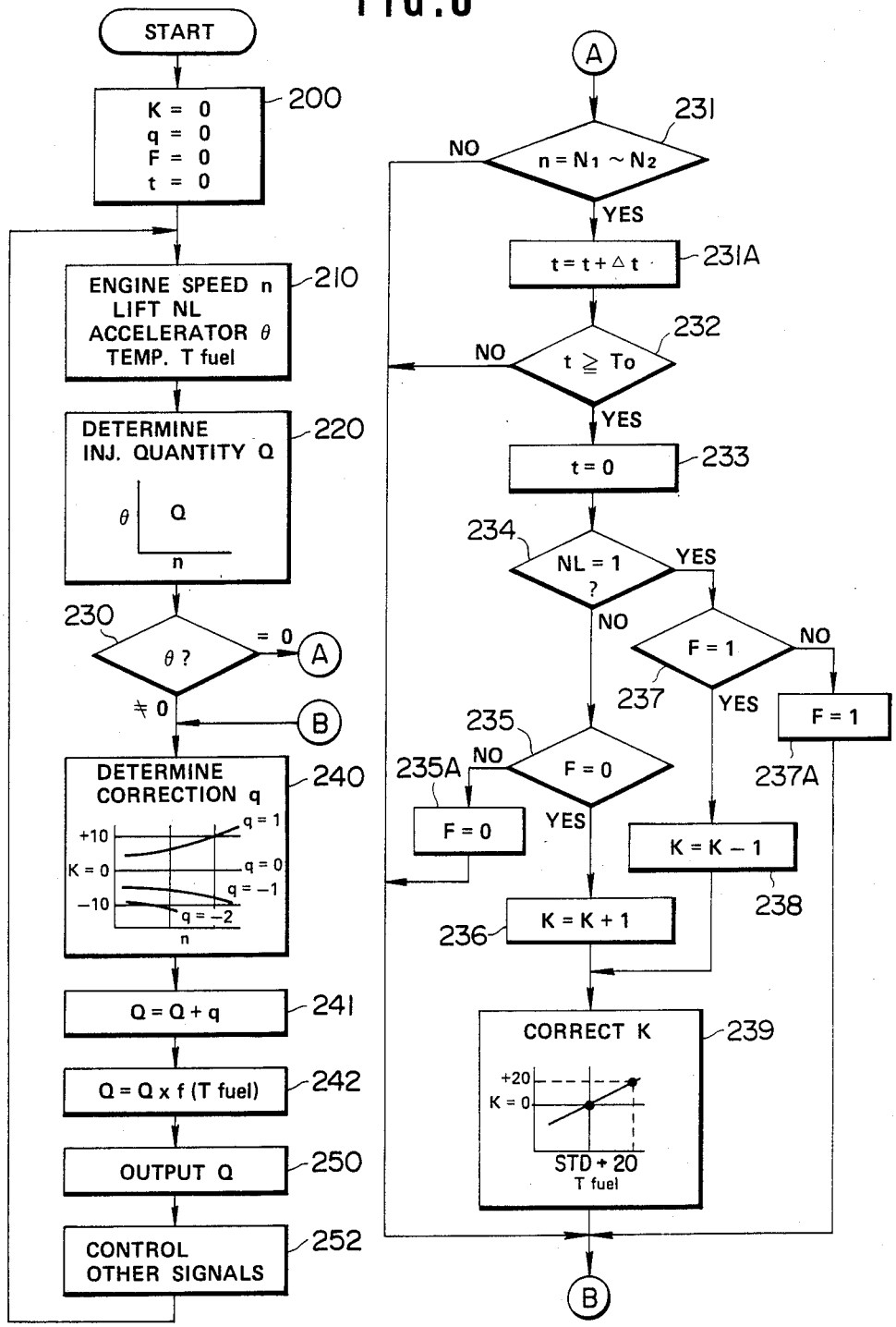
FIG. 8 is a flowchart of a program for controlling the operation of the control unit of FIG. 1.

The control unit 27 operates in accordance with a program stored in the ROM 29. FIG. 8 is a flowchart of this program. In a first step 200 of this flowchart, initialization is performed. In more detail, the variables K, q, F, and t are cleared to zero in this step 200. When the engine is started, the first step 200 is executed.

In a step 210 following the step 200, the current engine speed value is derived from the signal IS3. In this flowchart, the variable n represents this engine speed value. Then, an indication of whether or not any of the valve needles 108 of the fuel injection nozzles 6 is currently lifted from its closed position is derived from the signal IS7. In this flowchart, the variable NL represents this information. Specifically, the variable NL is zero when any of the valve needles 108 is in its closed position, that is, when fuel injection is not performed. The variable NL is one when any of the valve needles 108 is lifted from its closed position, that is, when fuel injection is performed. It should be noted that fuel injection remains interrupted as long as all of the valve needles 108 remain in their closed positions and is being performed whenever one of the valve needles 108 is lifted from its closed position. Third, the degree of depression of the accelerator pedal is derived from the signal IS1. In this flowchart, the variable $\theta$ represents this accelerator depression degree. Finally, the value of fuel temperature is derived from the signal IS13. In this flowchart, the variable Tfuel represents this fuel temperature value.

In a step 220 following the step 210, the desired fuel injection quantity value is determined on the basis of the engine speed value n and the accelerator depression degree $\theta$. In this flowchart, the variable Q represents this desired fuel injection quantity. Specifically, the ROM 29 holds a table in which a set of desired values of fuel injection quantity are plotted as a function of the engine speed and the accelerator depression degree. The determination of the desired fuel injection quantity Q is carried out by referring to this table.

In a step 230 following the step 220, a determination is made about whether or not the accelerator depression degree $\theta$ is equal to zero. If the accelerator depression degree $\theta$ is equal to zero, the program advances to a step 231. If the accelerator depression degree $\theta$ is not equal to zero, the program advances to a step 240. It should be noted that the accelerator pedal is released when the engine is coasting.

In the step 231, a determination is made about whether or not the engine speed value n resides in a range between preset values N1 and N2, preferably between 2,000 r.p.m. and 2,400 r.p.m. If the engine speed value n resides within this range, the program advances to a step 231A. If the engine speed value n is out of the given range, the program advances to the step 240. This engine speed range is preferably chosen to indicate engine coasting or braking, provided that the accelerator depression degree $\theta$ is zero.

In the step 231A, the calculation "$t=t+\Delta t$" is executed, where $\Delta t$ is a preset value. In other words, the variable t is incremented by the preset value $\Delta t$. This variable t represents the time elapsed since the commencement of engine coasting. It should be noted that the execution frequency of the program is generally constant. Alternatively, a counter or timer may be provided in the I/O circuit 31 to measure real time.

In a step 232 following the step 231A, a determination is made about whether or not the elapsed time t is equal to or greater than a preset interval To, preferably three to five seconds. If the elapsed time t is equal to or greater than the preset interval To, the program advances to a step 233. If the elapsed time t is less than the preset interval To, the program advances to the step 240.

In the step 233, the variable t is cleared to zero. In other words, "t=0" is executed. After the step 233, the program advances to a step 234.

In the step 234, a determination is made about whether or not fuel injection is actually occurring on the basis of the variable NL. If the variable NL is zero, that is, if fuel injection is not currently being performed, the program advances to a step 235. If the variable NL is one, that is, if fuel injection is being performed, the program advances to a step 237.

In the step 235, a determination is made about whether or not the variable F is equal to zero. If the variable F is equal to zero, the program advances to a step 236. If the variable F is not equal to zero, the program advances to the step 240 by way of a step 235A in which the variable F is set to zero.

In cases where the program advances to the step 236, since fuel injection is not occurring, the duty cycle of the control signal OS4 must reside within the dead zone $\alpha$ of FIG. 4. Since it is necessary to determine the critical duty cycle value Po at which the fuel injection quantity first exceeds or rises from zero, the variable K, used to find and correct for deviation of the critical duty cycle of the control signal OS4, is incremented by one in the step 236. In other words, "K=K+1" is executed. After the step 236, the program advances to a step 239.

As will be made clear hereinafter, the step 236 for increasing the duty cycle of the control signal OS4 is reiterated until fuel injection can be detected on the basis of the signal IS7 in the step 234, that is, until the critical duty cycle value Po is reached.

In the step 237, a determination is made about whether or not the variable F is equal to one. If the variable F is not equal to one, the program advances to the step 240 by way of a step 237A in which the variable F is set to one. If the variable F is equal to one, the program advances to a step 238.

In cases where the program advances to the step 238, fuel injection is already occurring and thus the duty cycle of the control signal OS4 is equal to or greater than the critical value Po so that the further incrementation of the duty cycle is unnecessary. Accordingly, the variable K is decremented by one in the step 238. In other words, "K=K−1" is executed. After the step 238, the program advances to the step 239.

The steps 235, 235A, 237, and 237A are intended to provide hysteresis to help stabilize the variable K after the critical duty cycle value has been found. As the variable NL changes from one value to another, the duty cycle of the control signal OS4 remains unchanged in the first execution cycle of the program after each change in the variable NL.

In the step 239, the variable K is corrected on the basis of the measured fuel temperature value Tfuel. It should be noted that at a fixed duty cycle of the control signal OS4, the density of fuel decreases and thus the fuel injection quantity increases as the fuel temperature rises. In this step 239, the calculation "$K=g(K, T\text{fuel})$" is performed, where g(K, Tfuel) is a preset function of the fuel temperature value Tfuel and the value of the variable K. After the step 239, the program advances to the step 240.

Preferably, $g=K-(T\text{fuel}-T\text{ref})\cdot G$, where Tref is a reference temperature set under normal conditions and G is the rate of change of the value K per unit of temperature °C. In the case where K is 20, Tfuel is 50° C., Tref is 30° C., and G is one per C°: $g=20-(50-30)\times 1=0$ so that K is corrected to zero.

In the step 240, a desired correction to the quantity of fuel injected is determined on the basis of the value K and the engine speed value n. In this flowchart, the variable q represents this desired correction to the fuel injection quantity. Although it might seem more efficient to derive the correction value q directly from the critical duty cycle Po, the illustrated program actually requires much less time during normal engine operation to derive an accurate up-to-date correction value q. That is, the value K can from time to time be laboriously determined in the limited engine speed range between the values N1 and N2 and then the value q can be easily derived from K and the current engine speed value n. Preferably, the value q is zero when the value K is zero.

In a step 241 following the step 240, the sum of the values Q and q is stored in the variable Q representing the desired fuel injection quantity. In other words, "Q=Q+q" is executed. After the step 241, the program advances to a step 242.

In the step 242, the value Q representing the desired fuel injection quantity is corrected on the basis of the fuel temperature. Specifically, the value Q multiplied by f(Tfuel) is stored in the variable Q, where f(Tfuel) is a preset function of the temperature value Tfuel. In other words, "Q=Q·f(Tfuel)" is executed.

In a step 250 following the step 242, the duty cycle of the control signal IS4 is adjusted to a value corresponding the value Q finally determined in the step 242. Accordingly, the control sleeve 60 is moved to a position at which a quantity of fuel equal to the desired fuel injection quantity Q is injected. After the step 250, the program returns to the step 210 by way of a block 252 in which steps for controlling the other signals OS1, OS2, OS3, OS5, OS6, and OS7 are taken.

The value K is updated each time the engine coasts. In some cases, a time interval between periods of engine coasting is long enough for the fuel temperature to change significantly. The temperature correction of the values K and Q prevents erroneous control of the fuel injection quantity due to possible considerable temperature variations over the intervals between periods of engine coasting.

As the engine starts and runs, the fuel temperature gradually increases. Accordingly, the fuel temperature usually increases during the intervals between periods of engine coasting. These temperature increases would cause unwanted decreases in the fuel injection quantity if not prevented by the temperature correction of the values K and Q.

The temperature correction of the values K and Q may be omitted. In this case, the temperature sensor 85 is unnecessary. In the absence of this temperature correction, as the fuel temperature increases during the intervals between periods of engine coasting, the fuel injection quantity decreases so that the emission of smoke from the engine can be reduced.

Figure 9:
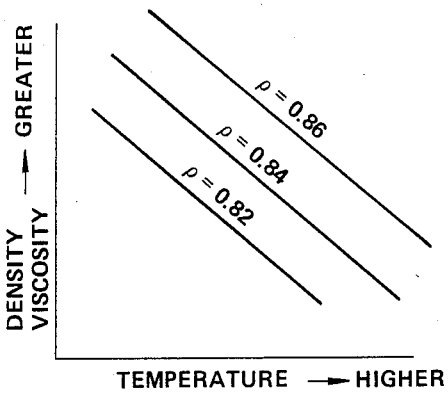
FIG. 9 is a graph of the relationship between the fuel temperature and the density (kinematic viscosity) of three kinds of fuel.

FIG. 9 shows the relationship between fuel temperature and fuel density (kinematic viscosity). As the fuel temperature rises, the fuel density decreases. This proportionality is essentially constant regardless of the fuel density $\theta$ at standard temperature.

Figure 10:
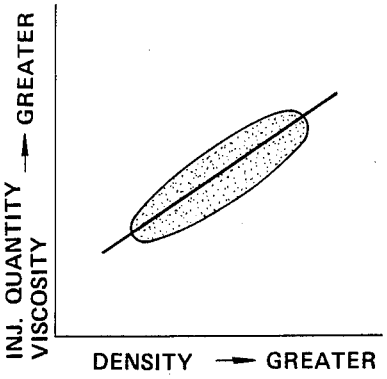
FIG. 10 is a graph of the relationship between fuel density and kinematic viscosity (injection quantity).

FIG. 10 shows the relationship between fuel density and fuel kinematic viscosity (injection quantity). The fuel density is approximately proportional to the fuel kinematic viscosity (injection quantity).

In the case of light fuel having a low density at normal temperatures, the value K at the moment of change of the variable NL to the state indicative of fuel injection is large. Since the fuel injection correction quantity q increases with this value K, the sum of the values Q and q in the step 241 is greater than that in the case of normal fuel. As a result, the fuel injection quantity in terms of volume is increased in comparison with that for normal fuel. This prevents a shortage of injected fuel in terms of mass.

In the case of heavy fuel having a high density at normal temperatures, the value K at the moment of change of the variable NL to the state indicative of fuel injection is small, so that the sum of the values Q and q in the step 241 is smaller than that in the case of normal fuel. As a result, the fuel injection quantity in terms of volume is decreased in comparison with that for normal fuel. This prevents an excess of injected fuel in terms of mass.

When the variable K is zero, the fuel injection correction value q is also zero so that the fuel injection quantity is equal to the level used for normal fuel.

In summary, the determination of the value K representing a fuel injection correction factor is performed when the accelerator pedal is released and thus fuel injection is unnecessary. In determining the value K, the duty cycle of the control signal OS4 is gradually changed from the no-injection state while the presence or absence of actual fuel injection via the fuel injection nozzles 6 is monitored on the basis of the signal IS7. The value K is determined in accordance with the duty cycle value at which fuel injection starts to occur. This critical duty cycle is compared to a reference duty cycle determined in the case of normal fuel. The deviation of fuel injection quantity from that for normal fuel is determined on the basis of the difference between these two duty cycles. The fuel injection correction quantity q is determined in accordance with this deviation. In the step 241, the sum of the values Q and q is calculated to correct the fuel injection quantity. It should be noted that the value q may be negative in some cases.

This invention is based on the fact that the fuel density is closely related to the kinematic viscosity of fuel and also that the quantity of fuel injected via the fuel injection pump is closely related to the kinematic viscosity of fuel. In this invention, the resulting relationship between the density of fuel and the fuel injection quantity is used to determine actual fuel density on the basis of the effective fuel injection quantity. The determined fuel density is incorporated into a parameter for control of fuel injection quantity to improve the accuracy and reliability of control from the standpoint of fuel mass. It should be noted that conventional systems provide control of fuel injection quantity in terms of volume. Specifically, in this invention, the determination of the fuel density is based on the detection of the duty cycle value of the control signal OS4 at which the fuel injection quantity first exceeds or rises from zero. Thus, it is unnecessary to provide a sensor for directly sensing the density of fuel.

To this invention, the accuracy and reliability of control of fuel injection quantity in terms of mass remains independent of the type of fuel of whatever density. Also, the accuracy and reliability of control remains independent of the degree of abrasive wear on the sliding parts of the high-pressure pump 38 which would influence the fuel injection quantity. As the fuel injection quantity at a fixed position of the control sleeve 60 increases, the value K determined during engine coasting decreases so that the duty cycle of the control signal OS4 corresponding to a fixed fuel injection quantity also decreases. This decrease in the duty cycle moves the control sleeve 60 in the direction of reducing the fuel injection quantity.

In the step 236, the increment to the variable K may be a value other than one.

During the interval between engine start-up and the first period of engine coasting, the value K remains zero in the illustrated embodiment of this invention so that control of fuel injection quantity is similar to that under normal fuel conditions. The normal duty cycle corrections dependent on the kind of fuel may alternatively be stored in a non-volatile memory. In this case, the reliability of control of fuel injection quantity is improved during that initial interval.

Figure 11:
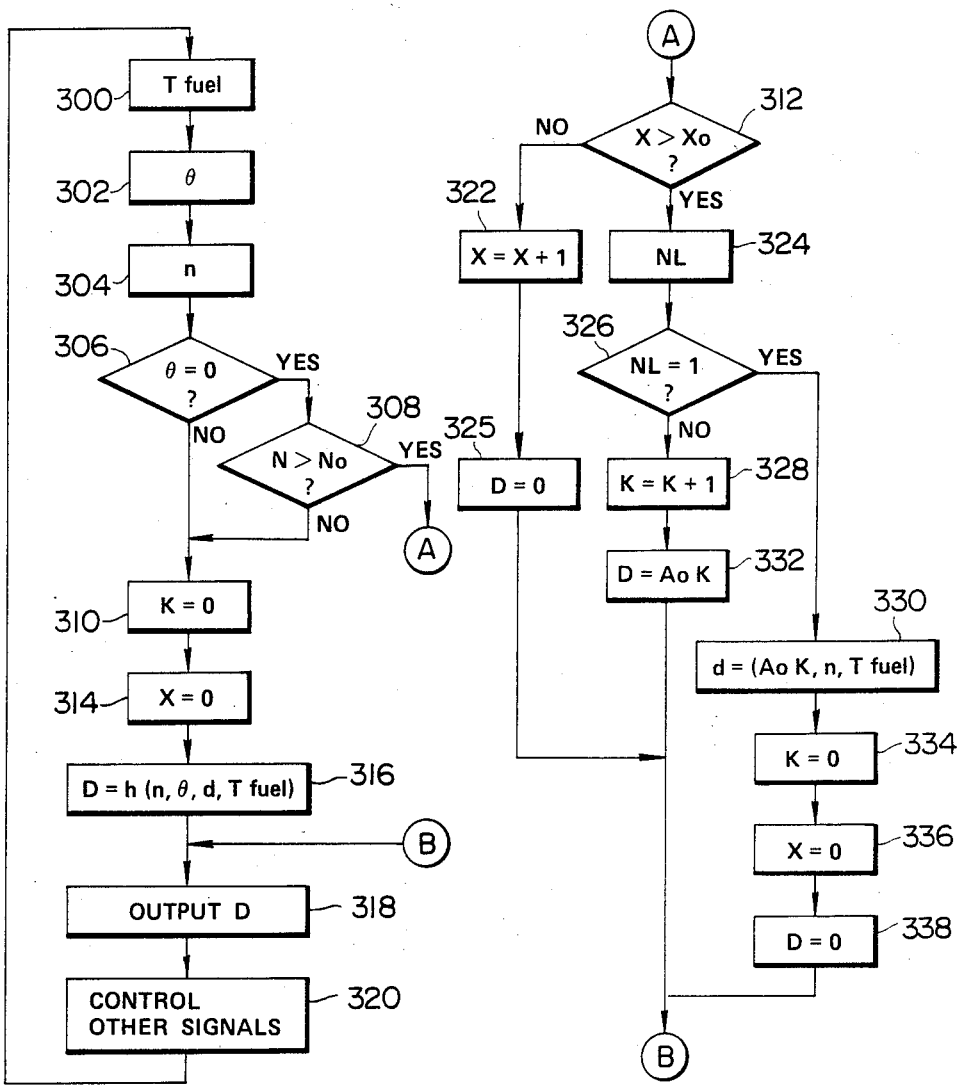
FIG. 11 is a flowchart of a program for controlling the operation of the control unit of FIG. 1 which may be used in place of the program charted in FIG. 8.

FIG. 11 is a flowchart of a program for controlling the operation of the control unit 27 which may be used in place of the program flowchart of FIG. 8. In a first step 300 in this flowchart, the current value of fuel temperature is derived from the signal IS13. In this flowchart, the variable Tfuel represents this fuel temperature value.

In a step 302 following the step 300, the current degree of depression of the accelerator pedal is derived from the signal IS1. In this flowchart, the variable $\theta$ represents this accelerator depression degree.

In a step 304 following the step 302, the current value of the engine speed is derived from the signal IS3. In this flowchart, the variable n represents this engine speed value.

In a step 306 following the step 304, a determination is made about whether or not the accelerator depression degree is zero. If this value $\theta$ is zero, that is, if the accelerator pedal is released, the program advances to a step 308. If this value $\theta$ is not zero, that is, if the accelerator pedal is depressed, the program advances to a step 310.

In the step 308, a determination is made about whether or not the engine speed value n exceeds a preset reference value No indicative of engine coasting. If the engine speed value n does not exceed the preset value No, the program advances to the step 310. If the engine speed value n exceeds the preset value No, the program advances to a step 312.

Accordingly, if the eigne is not coasting, the program advances from the step 306 directly or indirectly to the step 310. If the engine is coasting, the program advances from the step 306 to the step 312 by way of the step 308.

In the step 310, the variable K is set to zero. As will be made clear hereafter, this variable K is used in determining the duty cycle value of the control signal OS4 at which the fuel injection quantity first exceeds or rises from zero.

In a step 314 following the step 310, the variable X is set to zero. As will be made clear hereafter, this variable X is used to measure a time interval.

In a step 316 following the step 314, the value D representing the desired duty cycle of the control signal OS4 is determined by means of the equation "$D=h(n, \theta, T\text{fuel}, d)$", where $h(n, \theta, T\text{fuel}, d)$ is a preset function of the engine speed value n, the accelerator depression degree $\theta$, the fuel temperature value Tfuel, and a value d determined during the engine coasting. In more detail, the ROM 29 holds a table in which a set of desired duty cycle values are plotted as a function of the parameters n, $\theta$, Tfuel, and d. The determination of the desired duty cycle D is carried out by referring to this table. As will be made clear below, the value d is a function of fuel characteristics, other than the fuel temperature, influencing the fuel density. The factor d is in essence the intrinsic fuel density.

In a step 318 following the step 316, the desired duty cycle D is outputted to a register in the I/O circuit 31 for determining the actual duty cycle of the control signal OS4. As a result, the actual duty cycle of the control signal OS4 is adjusted to a value equal to the desired value D.

After the step 318, the program returns to the step 300 by way of a block 320 in which steps for controlling the other signals OS1, OS2, OS3, OS5, OS6, and OS7 are taken.

The desired duty cycle D is updated as the parameters n, $\theta$, Tfuel, and d vary. The actual duty cycle of the control signal OS4 follows this desired value D. It should be noted that the actual fuel injection quantity is proportional to the duty cycle of the control signal OS4.

In the step 312, a determination is made about whether or not the value X exceeds a preset value Xo. If the value X does not exceed the preset value Xo, the program advances to a step 322. If the value X exceeds the preset value Xo, the program advances to a step 324.

In the step 322, the variable X is incremented by one. In other words, "X=X+1" is executed. After the step 322, the program advances to the step 318 by way of a step 325 in which the desired duty cycle D is set to zero. As long as the engine continues to coast, the program continues to run through the step 325 and thus the desired duty cycle D remains zero until the time elapsed since the commencement of engine coasting exceeds an interval represented by the preset value Xo. It should be noted that the execution frequency of the program is essentially constant. Setting the duty cycle of the control signal OS4 to zero causes fuel injection to be continuously disabled. In cases where the engine continues to coast long enough, the program advances to the step 324 after the elapsed time exceeds the interval represented by the preset value Xo. In view of response lag, this value Xo is chosen to ensure that actual fuel injection has fully stopped by the time at which the specified interval has elapsed.

In the step 324, an indication of whether any of the valve needles 108 of the fuel injection nozzles 6 is lifted from its closed position is derived from the signal IS7. In this flowchart, the variable NL represents this information. Specifically, the variable NL is zero when any of the valve needles 108 is not lifted from its closed position, that is, when fuel injection is not performed. The variable NL is one when any of the valve needles 108 is lifted from its closed position, that is, when fuel injection is performed.

In a step 326 following the step 324, a determination is made about whether or not fuel injection is actually occurring on the basis of the variable NL. If the variable NL is zero, that is, if fuel injection is not occurring, the program advances to a step 328. If the variable NL is one, that is, if fuel injection is occurring, the program advances to a step 330.

In the step 328, the variable K is incremented by one. In other words, "K=K+1" is executed. After the step 328, the program advances to a step 332.

In the step 332, the value K multiplied by a preset positive constant Ao is stored in the variable D determining the duty cycle of the control signal OS4. In other words, "$D=Ao\cdot K$"is executed. After the step 332, the program advances to the step 318.

In cases where engine coasting lasts for longer than the interval represented by the constant Xo, first the fuel injection is disabled so that the program executes the steps 328 and 332. As a result, the duty cycle of the control signal OS4 is periodically incremented by the constant Ao. Incrementing the duty cycle moves the control sleeve 60 toward a position at which fuel injection occurs. When fuel injection starts again, the program advances to the step 330 from the step 326. At this moment, the value Ao·K represents the duty cycle of the control signal OS4 at which the fuel injection quantity first exceeds or rises from zero.

In the step 330, the value d is determined by means of the equation "$d=j(Ao\cdot K, n, T\text{fuel})$", where j(Ao·K, n, Tfuel) is a preset function of the value Ao·K, the engine speed value n, and the fuel temperature value Tfuel. This value d is a factor of fuel characteristics, other than the fuel temperature, influencing fuel density. The value d is in essence the intrinsic fuel density.

In a step 334 following the step 330, the variable K is set to zero. After the step 334, the program advances to a step 336.

In the step 336, the variable X is set to zero. After the step 336, the program advances to the step 318 by way of a step 338 in which the variable D is set to zero. In this way, after the determination of the fuel density value d has been completed, the duty cycle of the control signal OS4 is reset to zero.

The fuel density value d is determined on the basis of the critical value of the duty cycle of the control signal OS4 at which the fuel injection quantity first exceeds or rises from zero. This determination of the value d is performed during engine coasting. In general, the fuel density value d is updated whenever the engine is coasting. In the step 316, the duty cycle value of the control signal OS4 is derived from parameters including this fuel density value d. The use of this value d in determining the duty cycle is intended to make the fuel injection quantity controlled in terms of mass independent of the intrinsic fuel density which differs among different kinds of fuel. It should be noted that the use of the fuel temperature value Tfuel in determining the duty cycle is designed to make control of the fuel injection quantity in terms of mass independent of fuel temperature.

What is claimed is:

1. A fuel injection rate control system for an engine, comprising:

(a) means for injecting fuel into the engine;

(b) movable means for adjustably determining a rate of fuel injection into the engine, the fuel injection rate depending on the position of the movable means;

(c) means for detecting a critical position of the movable means defining a boundary between first and second ranges of the position of the movable means, fuel injection being performed in the first range and being disabled in the second range;

(d) means for sensing an operating condition of the engine; and (e) means for controlling the movable means on the basis of the sensed engine operating condition and the detected critical position.

2. The system of claim 1, further comprising:

means for detecting when the engine is coasting;

and wherein:

the detection of the critical position is performed when the engine is coasting; and the control of the movable means on the basis of the engine operating condition and the critical position is performed only when the engine is not coasting.

3. The system of claim 1, wherein the critical position detecting means comprises:

(a) means responsive to a varying control signal for moving the movable means from the second range to the first range;

(b) means for sensing the occurrence of fuel injection; and (c) means for supplying the control signal to the moving means, and for recording the state of the control signal when the occurrence of the fuel injection is first sensed, the recorded state of the control signal representing the critical position of the movable means.

4. A method of controlling the rate of fuel injection into an internal combustion engine, comprising the steps of:

(a) monitoring engine operating conditions including engine load;

(b) detecting when fuel is being injected into the engine;

(c) when no fuel is being injected and the engine load is essentially null, adjusting the operating state of a fuel injection device until fuel is first detected to be injected into the engine, the operating state of the fuel injection device at that time being recorded as a critical state value;

(d) deriving a desired fuel injection quantity on the basis of monitored engine operating conditions and said critical state value; and (e) adjusting the operating state of the fuel injection device to a state in which the desired fuel injection quantity is injected into the engine.

5. A fuel injection rate control system for an engine, comprising:

(a) means for injecting fuel into the engine;

(b) movable means for adjustably determining a rate of fuel injection into the engine, the fuel injection rate depending on the position of the movable means;

(c) means for measuring a critical position of the movable means, the critical position defining a boundary between first and second ranges of the position of the movable means wherein fuel injection is respectively performed and disabled;

(d) means for sensing an operating condition of the engine; and (e) means for controlling the movable means as a function of the sensed engine operating condition and the measured critical position.

* * * * *